US009673535B2

(12) United States Patent
Lebrun et al.

(10) Patent No.: US 9,673,535 B2
(45) Date of Patent: Jun. 6, 2017

(54) TELECOMMUNICATION ANTENNA REFLECTOR FOR HIGH-FREQUENCY APPLICATIONS IN A GEOSTATIONARY SPACE ENVIRONMENT

(71) Applicant: THALES, Neuilly-sur-Seine (FR)

(72) Inventors: Florent Lebrun, Mauzac (FR); Patrick Martineau, Blagnac (FR)

(73) Assignee: THALES, Courbevoie (FR)

( * ) Notice: Subject to any disclaimer, the term of this patent is extended or adjusted under 35 U.S.C. 154(b) by 821 days.

(21) Appl. No.: 13/941,410

(22) Filed: Jul. 12, 2013

(65) Prior Publication Data

US 2014/0015735 A1 Jan. 16, 2014

(30) Foreign Application Priority Data

Jul. 13, 2012 (FR) ..... 12 01995

(51) Int. Cl.
*H01Q 15/14* (2006.01)
*H01Q 1/28* (2006.01)
*H01Q 15/16* (2006.01)

(52) U.S. Cl.
CPC ..... *H01Q 15/14* (2013.01); *H01Q 1/288* (2013.01); *H01Q 15/141* (2013.01); *H01Q 15/168* (2013.01)

(58) Field of Classification Search
CPC ..... H01Q 15/14–15/141
See application file for complete search history.

(56) References Cited

U.S. PATENT DOCUMENTS

| | | | | |
|---|---|---|---|---|
| 4,092,453 | A | 5/1978 | Jonda | |
| 4,242,686 | A | 12/1980 | Macturk | |
| 5,488,383 | A | 1/1996 | Friedman et al. | |
| 5,686,930 | A * | 11/1997 | Brydon | H01Q 15/168 343/897 |
| 9,350,083 | B2 * | 5/2016 | Zimmerman | H01Q 15/162 |
| 2007/0069970 | A1 | 3/2007 | Argaman et al. | |

FOREIGN PATENT DOCUMENTS

| | | |
|---|---|---|
| EP | 0948085 A2 | 6/1999 |
| FR | 2 294 820 A1 | 7/1976 |

* cited by examiner

*Primary Examiner* — Robert Karacsony
*Assistant Examiner* — Amal Patel
(74) *Attorney, Agent, or Firm* — Baker & Hostetler LLP

(57) ABSTRACT

An antenna reflector compatible with applications at high frequencies between 12 and 75 GHz and suitable for a paraboloidal or ellipsoidal geostationary space environment comprising a reflective face to focus electromagnetic radiation, comprises a superposition of at least one layer comprising a fiber composite material, the at least one layer of fiber composite material comprising angular sectors arranged around a center, each defined by a first central angle and oriented in a radial direction the median of the central angle, each of the angular sectors comprising the fiber composite material comprising first and second fibers oriented different first and second respective directions, the first direction forming a second angle with the radial direction of the angular sector. The angular sectors comprise three concentric areas: a central area, a peripheral area and an intermediate area situated between the central area and the peripheral area, the intermediate area forming a rim.

14 Claims, 4 Drawing Sheets

TELECOMMUNICATION ANTENNA REFLECTOR FOR HIGH-FREQUENCY APPLICATIONS IN A GEOSTATIONARY SPACE ENVIRONMENT

CROSS-REFERENCE TO RELATED APPLICATION

This application claims priority to foreign French patent application No. FR 1201995, filed on Jul. 13, 2012, the disclosure of which is incorporated by reference in its entirety.

FIELD OF THE INVENTION

The invention lies in the field of telecommunication satellites comprising passive antennas equipped with reflectors. The invention is particularly intended for applications in very high frequency bands of Ka and Q/V type but also meets the lesser technical requirements of the Ku frequency band.

BACKGROUND

The frequency band denoted Ku corresponds to frequencies between 12 and 18 GHz, or wavelengths between 2.5 and 1.6 cm. The frequency band denoted Ka corresponds to frequencies between 26.5 and 40 GHz or wavelengths between 11.3 and 7.5 mm.

The frequency band denoted Q/V corresponds to frequencies between 33 and 75 GHz or wavelengths between 9.1 and 3.3 mm.

There are a large number of applications involving reflector antennas. Their main aim is to attain high gains by constructing enormous reflectors, which is only possible for radio telescopes on the ground.

For satellites, the gains required are smaller (of the order of 40 to 50 dB), but the main limiting factors are the size and mass to be sent into space. In fact it is not possible to oversize the reflectors to improve the gain.

One of the solutions consists in using the antenna design of the Gregorian type, with two reflectors positioned face to face and making it possible to obtain in a small volume an antenna with a larger equivalent focal length.

For this type of antenna, the reflectors must:

- have a diameter between 250 and 1200 mm compatible with a space environment,
- exhibit a reflective profile manufactured with very high precision. The manufacturing defect of an active surface can be evaluated from the RMS value. The RMS value is the mean value of the standard deviations between the profile of the manufactured surface and the profile of the desired theoretical surface. Applications in Q/V frequency bands require the attainment of an RMS of the order of 20 microns,
- display a high stability for the reflective profile over a wide range of temperatures, from −200° C. to +200° C. This necessitates the use of materials with a low coefficient of thermal expansion.
- be stiff, in other words the first resonance mode must be greater than a frequency of 60 Hz for a defined type of antenna.
- be of low weight, typically a mass of less than 400 g for a reflector of 500 mm in diameter, for example, and
- be easy to implement so as to limit production costs.

A first conventional technology, so-called "thick shell" technology, is widespread. This technology relies on a so-called "sandwich" structure. A reflector manufactured using this technology comprises two membranes or skins and a spacer corresponding to a structure maintaining a relative position for the membranes and ensuring the stiffness of the "sandwich" structure thus formed. For space applications, the membranes are generally made using carbon reinforcement and the spacer is generally of "honeycomb" or CFRP (Carbon Fibre Reinforced Polymer) type.

This design is especially competitive for reflectors with a diameter between 1 and 2 m. The assembly of this type of structure is, however, too complex and therefore too expensive for reflectors of small diameter.

This technology also requires the use of a large quantity of adhesive, which is not compatible with applications at high temperatures.

Moreover, a reflector of a diameter of 500 mm manufactured using the so-called "thick shell" technology weighs 550 g. This technology does not make it possible to attain the weight targets set for applications in a space environment.

A second so-called "metallic" technology is used for the manufacture of reflectors of small diameter. The reflectors are conventionally produced by machining. This technology is advantageous from an economic point of view.

On the other hand, this technology performs poorly where weight targets are concerned. Indeed, the mass of a main reflector of 500 mm in diameter comprising an alloy of $Ta_6V$ type is around 900 g, or more than twice the desired weight targets for space applications.

A third so-called "Isogrid" technology described in Patent Application EP 0948085 performs very well technically.

This product is a reflector comprising a membrane on which is fixed a stiffening lattice. The stiffening lattice is a reinforcement grid forming a so-called "Isogrid" triangular pattern arranged adjacently to the first structure, the stiffening lattice being fixed to the membrane by adhesive bonding.

The complexity of assembly of the reinforcement grid means that this technology does not perform well from an economic point of view for reflectors of small diameter, in the same way as the so-called "thick shell" technology.

A fourth technology, so-called "monolithic technology with peripheral stiffener" makes it possible to overcome the problems related to weight.

This technology comprises a monolithic membrane onto which a peripheral stiffening ring is adhesively bonded. The stiffening ring is a rib comprising carbon, making it possible to stiffen the reflector and thus to attain the resonant frequency targets.

This solution brings an improvement in terms of the weight of the reflector, though the process of assembly and manufacture is not optimized.

Indeed, the production of a reflector using this technology seems to require the production of two separate moulds: a first mould to enable production of the active face of the reflector and a second mould to enable production of the peripheral stiffening ring.

Moreover, the cold-adhesive bonding of the peripheral stiffening ring onto the active face of the reflector limits the range of use temperatures.

SUMMARY OF THE INVENTION

It is an aim of the invention to develop a telecommunication antenna reflector that is compatible with high-frequency applications and suitable for a space environment, and that has a manufacturing process requiring few labour hours.

According to one aspect of the invention, an antenna reflector is proposed that is compatible with applications at high frequencies between 12 and 75 GHz and suitable for a geostationary space environment of paraboloidal or ellipsoidal shape comprising a reflective face making it possible to focus electromagnetic radiation. The reflector comprises a superposition of at least one layer comprising a fibre composite material, characterized in that at least one layer of fibre composite material comprises angular sectors arranged around a center, each of the angular sectors is defined by a first central angle, and is oriented in a radial direction that is the median of the central angle, each of the angular sectors comprises the fibre composite material comprising first fibres oriented in a first direction and second fibres oriented in a second direction that is different from the first direction, the first direction of the first fibres of an angular sector forming a second angle with the radial direction of the angular sector. The angular sectors comprise three concentric areas: a central area, a peripheral area and an intermediate area situated between the central area and the peripheral area, the intermediate area forming a rim.

Advantageously, the second angle is between 0° and 60°.

The use of a single fibre composite material guarantees low thermoplastic deformation.

The rim formed at the periphery of the active surface acts as a stiffening ring directly incorporated into the reflector, thereby avoiding the drawbacks encountered in so-called "monolithic technology with peripheral stiffener" that are related to the production of moulds and to the cold-adhesive bonding of the ring onto the active surface. In fact, the reflector thus produced makes it possible to limit the number of labour hours necessary.

Advantageously the reflector comprises at least one layer possessing a central part centered on the center, which facilitates the assembly of the angular sectors and prevents the angular sectors from overlapping at the center of the reflector.

According to another embodiment of the invention, a reflector as described previously is proposed in which the angular distance between the second angle of a first angular sector of a first layer and the second angle of a first angular sector of a second, successive layer is constant so as to ensure mechanical continuity between consecutive sectors.

Advantageously, the angular distance is between 0° and 60°.

Advantageously, the stack comprises between 2 and 10 layers, and preferably 6 layers. This value is a compromise between the weight of the reflector and the geometric quality of the reflector.

Some first sectors have a central angle ($\alpha_i$+X) and some second angular sectors have a central angle ($\alpha_i$−X), the value of X being set beforehand. A layer comprises a first angular sector then a second angular sector alternately.

Advantageously, the value of X is between 2° and 5°.

The first angular sectors of a layer cover the second angular sectors of the successive layer, so as to ensure continuity of the mechanical strength between consecutive sectors.

Reflector as described previously, in which the intermediate area (Zi) forms a rim of concave shape.

Reflector as described previously, in which the direction of the peripheral area (Zp) forms a third angle (γ) with a vertical axis passing through the centers (c) of the central parts (Pc) of the layers [$(C)_n$], the third angle (γ) being between 0° and 30°.

The layers have a diameter between 250 and 700 mm, and preferably of 500 mm.

According to one variant of the invention, the woven composite material comprises a fibrous material impregnated with a thermosetting resin enabling the reflector to attain use temperatures of 165° C.

According to another variant of the invention, the fibre composite material comprises a fibrous material impregnated with a thermoplastic resin enabling use temperatures greater than 200° C. to be attained.

Preferably, the fibrous material is a fabric. Alternatively, the fibrous material is of NCF (Non-Crimp Fabric) type.

BRIEF DESCRIPTION OF THE DRAWINGS

The invention will be better understood after studying a few embodiments described as in no way limiting examples, and illustrated by appended drawings, in which.

DETAILED DESCRIPTION

Figure 1A:
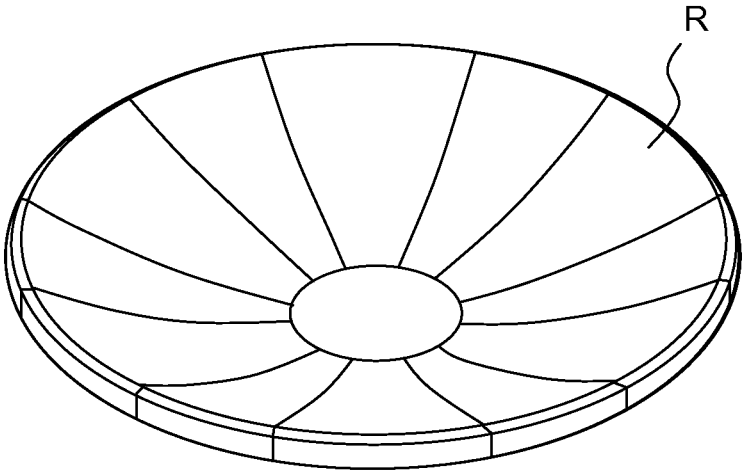
FIG. 1*a* shows a reflector, according to one aspect of the invention.

FIG. 1*a* illustrates a reflector R, comprising a fibrous material M of paraboloidal shape comprising a rim, the diameter of the reflector R being between 250 and 700 mm, and preferably 500 mm. Alternatively, the reflector can be of ellipsoidal shape.

The concave surface of the layer constitutes the reflective surface of the reflector R and is oriented towards the terrestrial globe. The rim acts as a stiffening ring enabling the structure to be stiffened and resonant frequencies of 60 Hz to be attained at a temperature of 20° C.

Figure 1B:
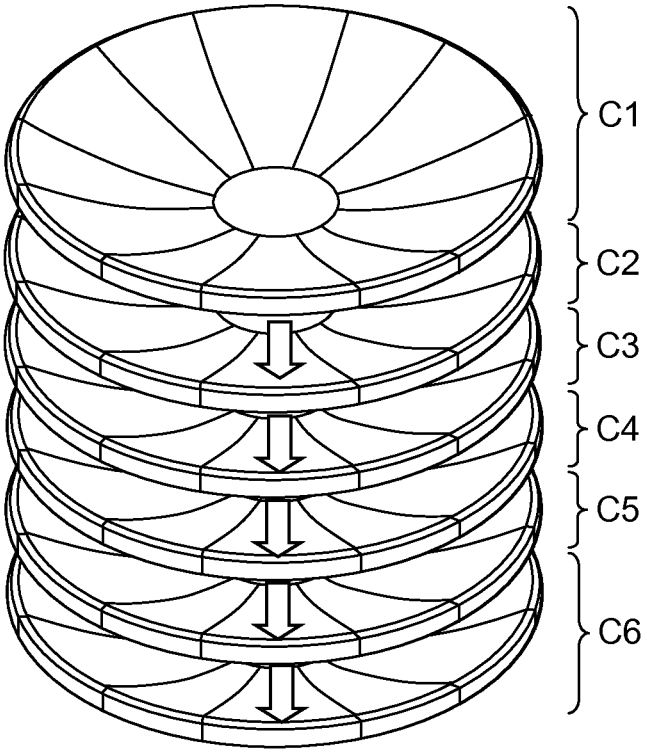
FIG. 1*b* shows a superposition of component layers of the reflector, according to one aspect of the invention.

FIG. 1*b* highlights the component elements of the reflector R. The reflector R comprises a stack of at least one layer $C_n$. Advantageously, the stack comprises between 2 and 10 layers, the number of layers $C_n$ depending on the type of material used. The required mechanical performance levels can be obtained by considering a superposition of six layers $C_1$-$C_6$.

Figure 2:
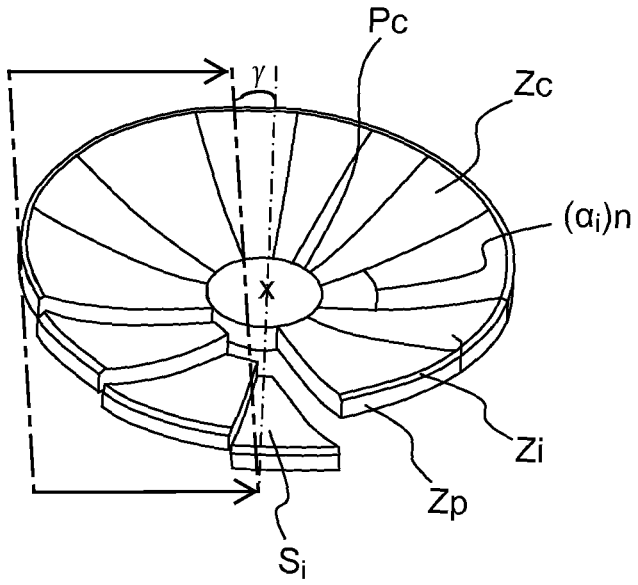
FIG. 2 shows the structure of a layer, according to one aspect of the invention.

FIG. 2 illustrates the different component parts of a layer $C_n$.

A layer $C_n$ comprises a central part Pc and angular sectors $(S_i)_n$, the truncated angular sectors $S_i$ being arranged around the central part Pc.

In a variant of the invention, the layer can comprise a center (c).

Additionally, the layer $C_n$ comprises three concentric areas: a first central area Zc, corresponding to the active surface of the reflector, a second peripheral area Zp and a third intermediate area Zi, the third intermediate area Zi forming a rim.

The intermediate area Zi is of concave shape with a small radius of curvature, typically 5 mm so as to limit the effects of parasitic reflections of the electromagnetic waves towards the source of the antenna. This radius cannot be further reduced due to the poor ability of the carbon fabrics to follow curves of small radius without breaking.

The axis of orientation of the peripheral area Zp forms an angle $\gamma$ with a vertical axis passing through the centers of the central parts Pc of the layers, forming a stiffener that is directly incorporated into the structure of the reflector, allowing the stiffness targets set for high-frequency telecommunication applications to be attained.

Figure 3:
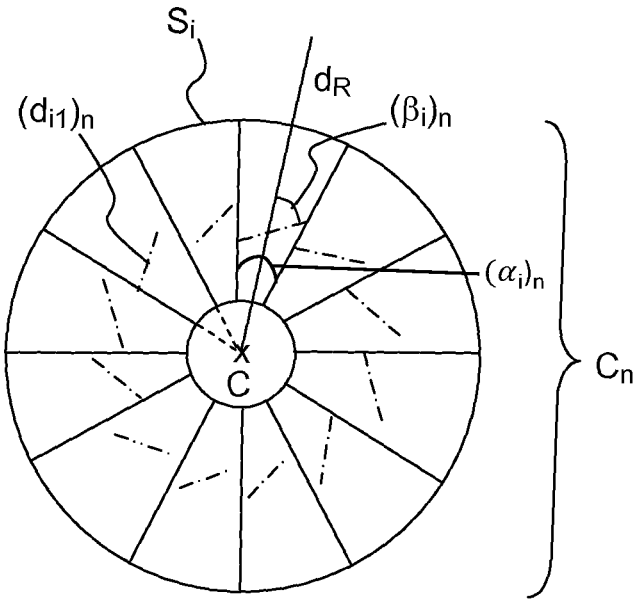
FIG. 3 illustrates the arrangement and orientation of the fibrous material in a layer of the reflector, according to one aspect of the invention.

FIG. 3 describes the arrangement and the orientation of the fibrous material M constituting the angular sectors $(S_i)_n$ of a layer $C_n$. The geometrical stability of the reflector in hot or cold temperatures is obtained partly by the use of a single composite material M for all of the component elements of the reflector R.

Preferably, the reflector design proposed is compatible with use of a material M comprising carbon fibres and a thermoplastic resin making it possible to attain a use temperature greater than 200° C.

Each of the angular sectors $(S_i)_n$ of a layer $C_n$ is respectively defined by a central angle $(\alpha_i)_n$ and oriented in a radial direction $d_R$ that bisects the central angle $(\alpha_i)_n$ of the angular sector $(S_i)_n$ under consideration.

An angular sector $(S_i)_n$ comprises a thermoplastic fibrous material M comprising first fibres f1 and second fibres f2. The first fibres f1 are oriented in a first direction $(d_{i1})_n$, i being an index corresponding to the sector under consideration and n being an index corresponding to the layer under consideration. The second fibres f2 are oriented in a second direction $(d_{i2})_n$, which is different from the first direction $(d_{i1})_n$. A first direction angle $(\beta_i)_n$ is defined as an angular distance between the first direction $(d_{i1})_n$ and the radial direction $d_R$ of the angular sector $(S_i)_n$.

The first direction angle $(\beta_i)_n$ is between 0° and 180° According to one aspect of the present disclosure, the first direction angle $(\beta_i)_n$ may be equal to 60° for all of the angular sectors $(S_i)_n$ of the layer $C_n$ illustrated in FIG. 3.

When the first direction angle $(\beta_i)_n$ is equal to 0°, the first fibres f1 of the woven material M are oriented in the radial direction $d_R$ of the angular sector $(S_i)_n$ under consideration.

Figure 4:
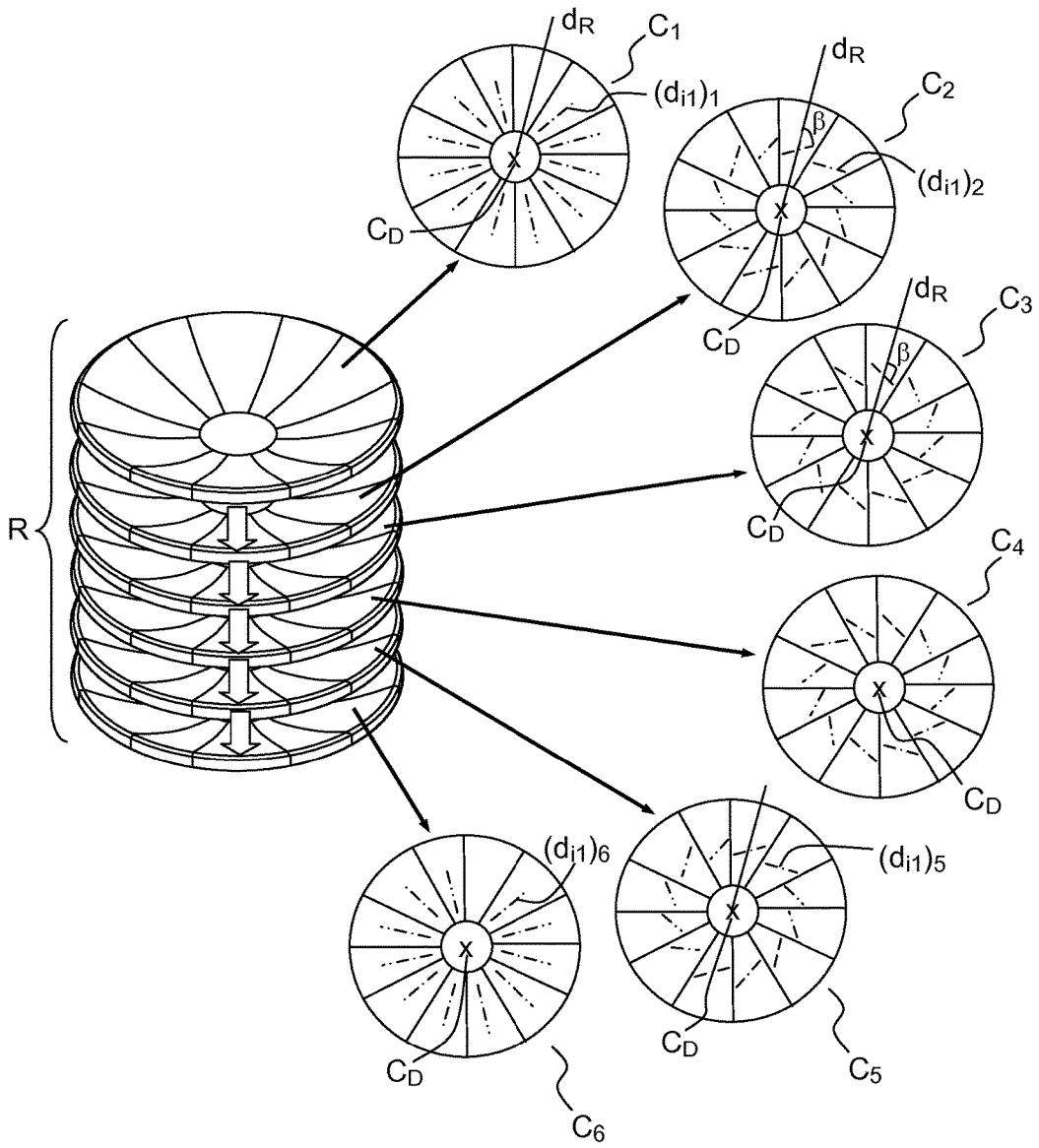
FIG. 4 shows the relative arrangement of the sectors comprising the fibrous material in the totality of the layers, according to one aspect of the invention.

FIG. 4 shows a stack of six layers $C_1$-$C_6$ and the arrangement of the material M constituting the angular sectors $(S_i)_n$ from one layer $C_n$ to the next $C_{n+1}$.

A first layer $C_1$ comprises angular sectors $(S_i)_1$ comprising a woven material M comprising first fibres f1 and second fibres f2 oriented as defined previously.

The first fibres f1 of a first angular sector $(S_1)_1$ of the first layer $(C)_1$ are oriented in a first direction $(d_{11})_1$, the first direction $(d_{11})_1$ forming a first direction angle $(\beta_1)_1$ with the radial direction $d_R$ of the first angular sector $(S_1)_1$. In this case, the first direction angle $(\beta_1)_1$ is nil, in other words the first fibres f1 are oriented in the radial direction $d_R$ of the first angular sector $(S_1)_1$.

The first fibres f1 of a first angular sector $(S_1)_2$ of the second layer $C_2$ are oriented in a first direction $(d_{11})_2$. According to one aspect of the present disclosure, a radial direction $d_R$ of the first angular sector $(S_1)_2$ of the second layer $C_2$ corresponds with the radial direction $d_R$ of the first angular sector $(S_1)_1$ of the first layer $C_1$. Due to the first direction angle $(\beta_1)_1$ of the first angular sector $(S_1)_1$ of the first layer $(C)_1$ being nil, the first direction $(d_{11})_2$ forms a first direction angle $(\beta_1)_2$ that is equal to a respective angle with the first direction $(d_{11})_1$ of the first sector $(S_1)_1$ of the first layer $C_1$. In this case, the first direction angle $(\beta_1)_2$ formed by the first direction $(d_{11})_2$ for the first fibres f1 of the first angular sector $(S_1)_2$ of the second layer $C_2$ is equal to 60°.

The angular distance $\theta$ corresponds to the difference in angle between the first direction $(d_{11})_2$ of the first fibres f1 of the first angular sector $(S_1)_2$ of the second layer $C_2$ and the first direction $(d_{11})_1$ of the first fibres f1 of the first sector $(S_1)_2$ of the first layer $C_1$, in other words $\theta=(\beta_1)_2-(\beta_1)_1$. According to an aspect of the present disclosure, angular distances $\theta$ may be the same (i.e. equal) from one layer to the next.

In one example of the configuration discussed above, the first fibres f1 of the first layer $C_1$ are oriented in the radial direction $d_R$ of the angular sector under consideration, the first fibres f1 of the second layer $C_2$ are oriented in a direction forming an angle of 60° with the radial direction $d_R$, and the first fibres of the third layer are oriented in a direction forming an angle of 120° with the radial direction $d_R$.

According to a variant of the invention, the angular distance $\theta$ is variable from one layer to the next.

Figure 5A:
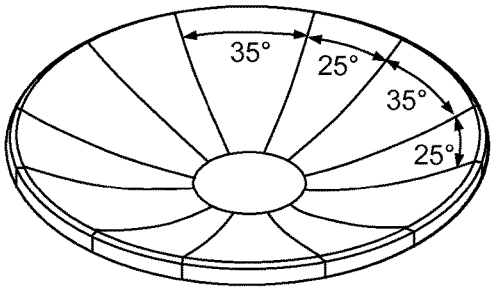
FIGS. 5*a* and 5*b* show the arrangement of the angular sectors as a function of the central angle in one layer and the arrangement of the angular sectors from one layer to the next, according to one aspect of the invention.

FIG. 5*a* shows the arrangement of the angular sectors $(S_i)_n$ as a function of the first central angles $(\alpha_i)_n$.

Some first sectors $S_A$ have a central angle $(\alpha_i+X)$ and some second angular sectors $S_B$ have a central angle $(a_i-X)$, the value of X being set beforehand. A layer $C_n$ comprises a first angular sector $S_A$ then a second angular sector $S_B$ alternately. Advantageously, the value of X is between 2° and 5°.

Figure 5B:
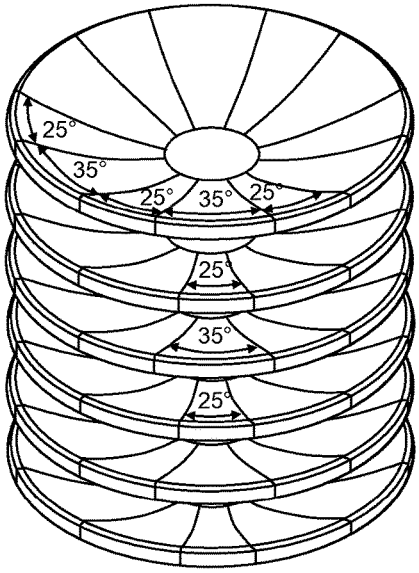

FIG. 5*b* shows the arrangement of the angular sectors $S_A$ and $S_B$ on a first layer $C_n$ and a second, successive layer $C_{n+1}$.

A first layer $C_n$ comprises first angular sectors $S_A$ of central angle $(\alpha+X)$ alternating with second angular sectors $S_B$ of central angle $(\alpha-X)$. A second, successive layer $C_{n+1}$ comprises an alternation of first sectors $S_A$ and second sectors $S_B$. The angular sectors are arranged in such a way that a first angular sector $S_A$ of the layer $C_n$ covers a second angular sector $S_B$ of the successive layer $C_{n+1}$. As a variant, the angular sectors $(S_i)_n$ can have random central angles $\alpha_i$, the angular sectors of a first layer $(C)_n$ at least partly covering the angular sectors of a second, successive layer $(C)_{n+1}$. The antenna reflector manufactured according to one aspect of the invention has a mass of less than 20% compared to a reflector manufactured using a "thick shell" technology, for example. This advantage is particularly beneficial for applications on antennas positioned on the earth side of satellites. In this type of configuration, the reflectors are positioned on the upper part of the satellite, and are therefore subject to large accelerations during launch.

Moreover, the reflector manufactured using the proposed technology does not have cold-adhesive bonding.

The invention claimed is:

1. An antenna reflector compatible with applications at high frequencies between 12 and 75 GHz, suitable for a geostationary space environment, and having a paraboloidal or ellipsoidal shape with a reflective face making it possible to focus electromagnetic radiation, the antenna reflector comprising:

a superposition of at least one layer formed from a fibre composite material, wherein the at least one layer includes a central part and angular sectors that are separate and distinct from the central part, wherein the angular sectors are separate and distinct from each other and arranged adjacently around the central part, wherein each angular sector comprises:

a central area, a peripheral area, and an intermediate area situated between the central area and the peripheral area, the intermediate area forming a rim, and wherein each angular sector of the angular sectors:

is defined by a central angle corresponding to the angle of the angular sector and oriented in a radial direction that bisects the central angle, and includes the fibre composite material having first fibres oriented in a first direction and second fibres oriented in a second direction that is different from the first direction, the first direction of the first fibres forming a first direction angle with the radial direction;

wherein the angular sectors of the at least one layer include first angular sectors alternating with second angular sectors, wherein each angular sector of at least a portion of the first angular sectors is defined by a respective central angle having a value of ($\alpha_i$+X), and wherein each angular sector of at least a portion of the second angular sectors is defined by a central an having a value of ($\alpha_i$−X).

2. The antenna reflector according to claim 1, wherein the first direction angle of each angular sector of the angular sectors is between 0° and 60°.

3. The antenna reflector according to claim 1, wherein the at least one layer includes a first layer, a second layer, and a third layer, and wherein a first angular distance between a first direction angle of a first angular sector of the first layer and a first direction angle of a first angular sector of the second layer is equal to a second angular distance between the first direction angle of the first angular sector of the second layer and a first direction angle of a first angular sector of the third layer.

4. The antenna reflector according to claim 1, wherein the at least one layer comprises between 2 to 10 layers.

5. The antenna reflector according to claim 3, wherein the first angular distance is between 0° and 60°.

6. The antenna reflector according to claim 1, wherein X is between 2° and 5°.

7. The antenna reflector according to claim 1, wherein the at least one layer includes a plurality of layers, wherein each of the plurality of layers includes first angular sectors and second angular sectors, and wherein first angular sectors of one of the plurality of layers cover second angular sectors of an other of the plurality of layers to provide continuity of mechanical strength between consecutive sectors.

8. The antenna reflector according to claim 1, wherein the intermediate area forms a rim of concave shape.

9. The antenna reflector according to claim 1, wherein a radial direction of the peripheral area forms an angle with a vertical axis passing through the center of the at least one layer, and wherein the angle is between 0° and 30°.

10. The antenna reflector according to claim 1, wherein the reflector has a diameter between 250 and 700 mm.

11. The antenna reflector according to claim 1, wherein the fibre composite material comprises a fibrous material impregnated with a thermosetting resin.

12. The antenna reflector according to claim 1, wherein the fibre composite material is a fibrous material impregnated with a thermoplastic resin.

13. The antenna reflector according to claim 11, wherein the fibrous material is a fabric.

14. The antenna reflector according to claim 1, wherein the at least one layer includes a first layer and a second layer, and wherein an angular distance between an angle of a first angular sector of the first layer and an angle of a first angular sector of the second layer is constant so as to ensure mechanical continuity between consecutive sectors.

* * * * *